United States Patent [19]

Wieser

[11] 3,942,584

[45] Mar. 9, 1976

[54] HOT WATER PUMP WITH COOLED SEALING HOUSING

[75] Inventor: Rudolf Wieser, Voitsberg, Austria

[73] Assignee: Maschinenfabrik Andritz Actiengesellschaft, Austria

[22] Filed: May 10, 1972

[21] Appl. No.: 251,868

[30] Foreign Application Priority Data

June 29, 1971 Austria ..... 5634/71

[52] U.S. Cl. ..... 165/47; 165/185; 165/134

[51] Int. Cl. ..... F24h 3/00

[58] Field of Search ..... 165/47, 1, 185, 134

[56] References Cited

UNITED STATES PATENTS 2,632,395 3/1953 Jennings et al. ..... 165/47

3,653,785 4/1972 Dahlgren et al. ..... 165/47

*Primary Examiner*—Charles Sukalo

*Attorney, Agent, or Firm*—James E. Bryan

[57] ABSTRACT

This invention relates to an improvement in a hot water pump having a cooled sealing housing inapump cover in the upper pump portion. The improvement comprises means mounting the sealing housing in a recess of the pump cover in a manner such that an annular air space is present between the outer surface of said sealing housing and the inner surface of the recess of the pump cover, said air space being in communication with the exterior space surrounding the pump.

41 Claims, 6 Drawing Figures

HOT WATER PUMP WITH COOLED SEALING HOUSING

The present invention relates to a hot water pump with a cooled sealing housing in the upper pump part.

Hot water pumps are employed — inter alia — in the technology of atomic power stations, as main cooling medium or agent pumps and as circulation pumps of La-Mont boilers. The temperature of the flow medium thereof may be up to 300°C, and the operating pressure thereof may be up to 160 atmospheres gauge. Hot water pumps of this type are generally built in a single stage and will then produce a pressure increase of approximately 5 to 12 atmospheres gauge.

When hot water pumps have a drive motor of normal construction (i.e. not an under-water motor), the sealing of the pump shaft represents a particularly delicate problem since it must extend from the interior pump space, being under a high pressure, outwardly to the motor. For purposes of decreasing the operating pressure, a set or series of shaft packings is used which is accommodated within a specific sealing housing.

During normal operation, blocking water having a temperature of approximately 45° is fed into the sealing housing by means of a blocking water pump, and specifically a high-pressure piston pump, which produces a pressure slightly higher than the operating pressure of the hot water pump. Of this blocking water, about one third flows out again toward the outside as leakage of the packings; the rest will pass on to the lower shaft or main bearing as lubricating water. This lubricating water should enter into the lower shaft bearing with as low a temperature as possible because it will then have a high viscosity and therefore a good lubricating effect. By virtue of the feeding of the blocking water into the sealing housing, the latter is maintained cool.

In case of a breakdown of the blocking water feeding or supplying device occurring while the hot water pump is running under normal operating conditions, i.e. when it has full operating pressure and full operating temperature, the following problems must be dealt with:

While the hot water pump which is shut off automatically in case of such a breakdown gradually stops running, no hot water must reach the sealing housing because otherwise a hot water eruption with steam discharge would take place, at which time in the case of reactor pumps, i.e. main cooling agent pumps, the emerging steam would also contain radioactive particles; the provision of an insulated cold-water storage space under the sealing housing can prevent this from happening. In case of a breakdown of the blocking water feeding means, cold water from the cold-water storage space or reservoir will reach the sealing housing while the hot water pump is gradually stopping, thus preventing an eruption of hot water. Once the hot water pump has come to a standstill, the pump shaft is so sealed by means of a seal or packing that it is completely free from any leakages.

After the hot water pump has gradually come to a stop, the sealing housing — even in the stationary condition thereof, i.e. when it has been heated up for several days with hot circulation water — should not reach a temperature higher than 150° because otherwise the sealing rings of the shaft packings, which consist of plastic materials, would be endangered.

In order to meet these requirements without a great expenditure, it is proposed by the present invention that the sealing housing be so disposed within a recess of the pump cover or lid that, between the outer jacket surface of the sealing housing and the inner surface of the recess of the pump cover, there be an annular air gap or space present which is in communication with the outer space surrounding the pump. By virtue of the presence of this annular air space, the temperature level of the sealing housing is considerably lowered, and specifically even when the blocking water supply has failed.

It is of particular advantage that the recess of the pump lid or cover in the vertical extension thereof be elongated by disposing at the pump lid a downward projection having an annular cross-section. This bracket of the pump lid or cover is expediently connectes at the lower end thereof by means of a tongue and groove with the lower end of the sealing housing in a manner such that the two parts will mutually support each other with respect to the pressure and temperature stresses. The sealing housing may be slid or inserted into the cylindrical bracket or projection of the pump lid either from above or from below. The sliding-in or insertion of the sealing housing from below has the large advantage that the housing is pressed upwardly by virtue of the operating pressure and that for this reason only small screws are required at the tongue-and-groove connection.

On the other hand, the introduction or insertion of the sealing housing from above involves or results in the fact that the thread of the housing must absorb the large axial force or stress which acts thereupon.

According to a further characteristic of the present invention, cooling water channels or ducts may be disposed at the cylindrical outer surface of the sealing housing, and connected thereto from above are the cooling water supply and discharge lines. The cooling water requirement is small and amounts to approximately 500 liters per hour. In order that, during the disassembly of the engine mounting, the cooling water pipe lines need not be dismantled, they are preferably installed closely above the pump lid and below the engine mounting. The high pressure pipes (i.e. the blocking water supply lines, and the leakage water discharge lines) are installed in the same manner.

According to another embodiment of the present invention, a cylindrical air circulation collar may be mounted within the annular air space between the sealing housing and the pump lid, this collar being closed at the upper end thereof, but open at the lower end thereof. In case of a breakdown of the blocking water, cooling air may be tangentially blown in, via a small ventilator, at the upper part of the air circulation collar. The cooling air requirement amounts to approximately 800 $m^3$ per hour.

In order to render it possible to keep the temperature of the pump lid as low as possible, cooling ribs may be cast on at the outer jacket or surface of the lid or cover.

A further characteristic of the present invention resides in the construction or provision of the pump cover in such a manner that the latter will be supported at the pump housing not only against the inner sealing surface but also against an outer supporting surface, and as a result, the stress of the cover by the acting forces will be reduced. In case of such a type of lid or cover, the bracket or projection thereof may be connected with the upper cooler cover portion, in which case the connecting point may be provided as a bead or reinforcement if desired. Cooling ribs may be provided at the inner surface of the cover bracket or projection. In order to eliminate heat transfer from the pump housing to the pump cover via the supporting surface, horizontal and vertical cooling bores are advantageously disposed in the cover. The annular space between the cover bracket or projection and the cover may be very effectively insulated from heat passage by means of an insulation, for example an insulation made up of a burled sheet. With this type of provision of the pump cover and the sealing housing, the supply of a specific cooling medium is no longer necessary even in case of a failure or breakdown of the blocking water. In order to keep the face pressure or pressure per unit area in the sealing surface considerably higher than in the supporting surface, the cover screws must be disposed as close as possible to the sealing surface.

In order to prevent a hot water eruption, in case of a failure or breakdown of the blocking water, even if the shaft cannot be sealed off toward the outside in a leakage-free manner once the pump has come to a standstill, the present invention further proposes that a cooler or condenser be so installed into the pump that, in case of such disturbance, the hot water passing from the inside of the pump into the sealing housing be adapted to be cooled by the cooler to below 100°C. For this purpose, this hot water is so guided by means of a guiding cylinder and through bores of the coolers that it touches the internal cooler at the inner and at the outer surface thereof. An optimal cooling effect of the cooler is attained in this manner.

This internal cooler acts, however, not only in the aforementioned case of a breakdown or failure, but it cools the lubricating water of the lower shaft bearing, during normal operation, to a temperature which is only a few degrees above that of the cooling water. As a result thereof, the viscosity of the lubricating water is more than doubled, and the lubricating effect thereof is thus improved. Furthermore, during normal operation, the cooler also draws off the heat flowing from the pump cover to the sealing housing.

The cooling water quantity that is necessary for the internal cooler amounts to approximately 10 $m^3$ per hour.

In order to improve as much as possible the effect of keeping the sealing housing, the cold water storage space or reservoir, and the lower shaft or main bearing cool, the following additional measures are proposed by the present invention:

The outer supporting or bracing tube which is secured to the pump cover and carries the distributor as well as the lower shaft bearing with the shaft and the traveling wheel, and which also may be subdivided into several portions, is so dimensioned in the upper part thereof that its outside diameter will coincide with the inside diameter of the pump housing except for the minimal radial play or tolerance of 1 to 2 millimeters being required. By virtue of such a narrow construction of this gap, convection flows therein are prevented, and an additional heat transport from the interior of the pump to the pump cover is thus effectively eliminated. In addition thereto, the rigidity and the oscillation or vibration behavior of the lower shaft bearing are improved thereby.

Furthermore, an inner supporting or bracing tube may be provided for which is disposed between the lower end of the cover bracket or projection and, respectively, the lower end of the sealing housing and the outer supporting or bracing tube. The rotational space being thus produced between the inner and the outer supporting or bracing tubes is filled with an insulation, such as burled sheet insulation. Accordingly produced between the pump cover and the lower shaft bearing is a single, cohesive insulating body without heat bridges which possesses a high heat insulation capacity.

During inspection of the lower shaft bearing, at which time it is pulled out of the pump, the burled sheet insulation remains in the pump. As a result of such provision, and by virtue thereof, it is possible - in the case of reactor main cooling medium pumps, where in the course of operation thereof radiating particles can penetrate or pass between the burled sheets — to prevent any danger to the assembling personnel because of such radiating particles as well as from any dripping water.

In order to even further delay the penetration of hot water into the cold water storage or reservoir, and as a consequence thereof into the sealing housing, in case of a blocking water failure or breakdown, the present invention proposes that a mixing chamber be disposed below the lower shaft bearing. As a consequence thereof, also the bushing of the lower shaft bearing is protected with respect to a heat shock stress in the case of a hot water eruption or break, since hot water will not instantaneously flow thereinto; instead, the temperature increase will take place more slowly. The content of the mixing chamber is equally protected against the heating-up thereof by means of the burled sheet insulation. If the lower shaft bearing is directly supported on the outer supporting or bracing tube — which may be necessary in view of a lack of space — a second annular insulating body may be disposed around the mixing chamber, which mixing body also covers the lower half of the lower shaft bearing and the lower shaft collar.

In order to render it possible that the shaft packings within the sealing housing be disassembled and checked without making it necessary at the same time to disassemble the upper shaft bearing and the pump motor, a shaft removal piece is provided for in a conventional manner.

Now, in order not to make it necessary during the control of the lower shaft bearing — at which time the latter is removed from the hot water pump — to also disassemble the upper shaft bearing and the pump motor, the following measures are proposed according to a further feature of the present invention.

The cold water storage space is provided as a double-walled container having a circular cross-section, whose outside diameter is so proportioned that it is adapted to be pulled out of the sealing housing remaining at the pump cover. As a result thereof, it is not necessary — during the control of the lower shaft bearing — to dismantle the sealing housing, which allows for a saving in disassembly work and disassembly time.

The lower shaft bearing is advantageously secured to the lower end of this cold water storage space and may be pulled out of the pump therewith. The shaft bearing then may be movably attached to the cold water storage space so that it be adapted to adjust to the shaft position. In order that, in this construction, the lubricating water flows only through the bearing gap proper, a fluid-tight bellows may be disposed between the lower shaft bearing and the cold water storage space. The lower shaft bearing, however, also may be rigidly secured to the cold water storage space, in which case the bellows becomes unnecessary.

When the length of the shaft disassembly or dismantling piece is shorter than the length of the cold water storage space, the latter is subdivided approximately in the center thereof and the two halves are detachably connected with each other.

In order to make it possible, in the case of a blocking water failure or breakdown, to keep the penetration of hot water into the sealing housing through the gap between the inner jacket of the cold water storage space and the shaft protective sleeve as small as possible, it is expedient to dimension the inside diameter of the inner jacket of the cold water storage space in such a manner that toward the shaft protective sleeve only a minimal radial gap of about 1 millimeter will remain. Additionally it is possible to dispose at the lower end of this gap one or several storage chambers whose content will likewise delay the penetration of hot water into the gap.

In order to avoid as much as possible a heating-up of the sealing housing via the pump shaft even after a prolonged period of time in case of a blocking water breakdown, a burled sheet insulation is disposed in the upper portion of the removable cold water storage space. The cold water storage space is secured with the upper portion thereof to the sealing housing. It is important also that the plastic sealing rings of the cold water storage space be disposed within the sealing housing where they cannot be heated unduly under normal conditions.

The bushing of the lower shaft bearing, being positioned on the side of the shaft, at the lower end of the protective shaft sleeve is so dimensioned with respect to the diameter thereof that it is adapted to be extracted with the protective shaft sleeve through the cold water storage space. The protective shaft sleeve is made in two parts, and two parts or portions are again detachably connected with each other.

If the hot water pump comprises an internal cooler of the type described hereinbefore, the lower shaft bearing is secured to a supporting tube which is adapted to be extracted therewith through the cooler and the sealing housing. This supporting tube, in turn, is divided into two parts and the halves are detachably connected with each other. Over a part of the vertical extension thereof it constitutes, together with the protective shaft sleeve, a narrow throttle gap. Disposed at the upper end of the lower half thereof is a burled sheet insulation. All of the plastic sealing rings of the supporting tube are arranged toward the inner cooler, and as a result thereof, the temperature thereof will not rise above 150°C even in case of a blocking water failure or breakdown and hot water eruption or break.

Two embodiments of the novel upper pump portion for hot water pumps as proposed by the present invention are illustrated in the accompanying drawings with several structural variants and by way of example, and wherein.

Figure 1:
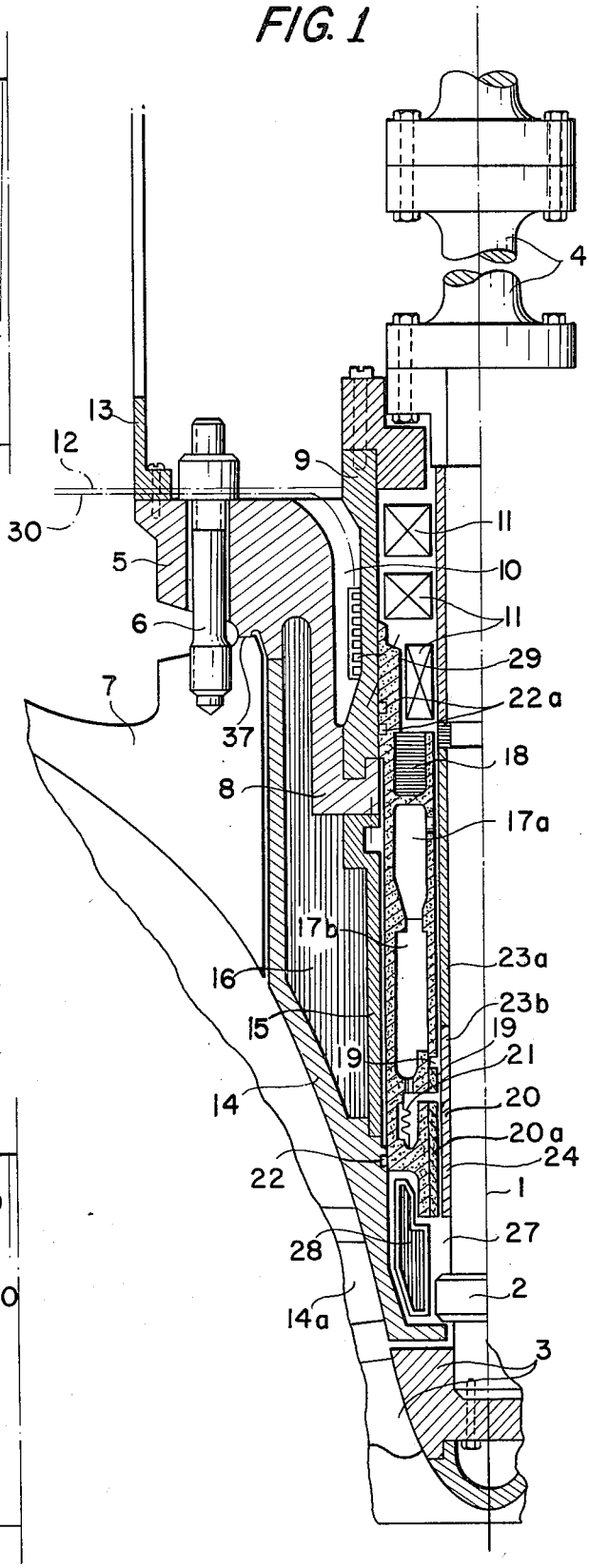
FIG. 1 is a longitudinal cross-sectional view through an upper pump portion of an axial pump without an internal cooler.

In the construction according to FIG. 1, the pump shaft 1 carries with the lower shaft collar 2 the travelling wheel 3. The shaft disassembling piece 4 is disposed between the pump and the upper pump bearing (not shown) and, respectively, the pump motor. The pump cover 5 is screwed to the pump housing 7 by means of the cover screws 6. The pump cover 5 has an outwardly extending cylindrical projection 8 which is connected at the lower end thereof — by means of a tongue and groove and a buttress thread — with the lower end of the sealing housing 9. Between the outer jacket or surface of the sealing housing 9 and the inner jacket or surface of the pump cover 5 and its projection 8, there remains an annular air space 10 which is in communication with the surroundin outer space or area. The shaft packings 11 are disposed in the sealing housing 9. The high-pressure pipe lines or pipings 12, which have been indicated in dash-dotted lines, leading to and from the sealing housing 9 (blocking water supply lines — leakage water discharge lines) are installed closely above the pump cover and are extended outwardly under the engine or motor mounting 13.

The outer supporting or bracing tube 14 is secured to the pump cover 5 and carries at the lower end thereof the distributor 14*a*. Under the projection 8 of the pump cover 5, the inner supporting or bracing tube 15 is disposed which is guided with the lower end thereof within the outer supporting or bracing tube 14. The hollow space 16 between the inner supporting or bracing tube 15 and the outer supporting or bracing tube 14 has an annular cross-section and is filled with burled sheets which are wound upon the projection 8 of the pump cover 5 and the inner supporting or bracing tube 15. The stagnant water which is within the narrow gaps between the burled sheets has a very good insulating effect.

Disposed inside the inner supporting or bracing tube 15 and in the lower area or zone of the sealing housing 9 is the double-walled cold water storage space (or reservoir) 17*a*, 17*b* being subdivided in the center thereof. In the upper portion thereof, toward the packings 11 of the sealing housing 9, an insulation 18 is provided. Arranged under the inner jacket or surface of the cold water storage space or reservoir 17*a*, 17*b* are two storage chambers 19. The lower shaft bearing 20 with the bushing 20*a* thereof is movably secured below to the cold water storage space or reservoir and sealed off by means of the metallic bellows 21. The radial support or mounting of the lower shaft bearing 20 is effected by means of four wedges 22 in the outer supporting or bracing tube 14. The lower shaft bearing 20 may be extracted upwardly with the cold water storage space or reservoir 17*a*, 17*b* through the sealing housing 9. All of the extractable parts or elements have been indicated by stippled hatching.

The plastic sealing rings 22*a* of the cold water storage space or reservoir 17*a*, 17*b* are disposed in the area of the sealing housing 9.

Figure 6:
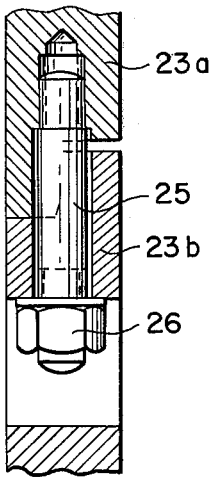
FIG. 6 illustrates as detail C of FIG. 4 the detachable screwed connection between the two halves of the protective shaft sleeve.

The protective shaft sleeve 23*a*, 23*b* is likewise subdivided and carries below the shaft-side sleeve or bushing 24. The detachable connection of the two halves 23*a*, 23*b* of the protective shaft sleeve takes place by means of the screws 25 and the nuts 26 (shown in detail in FIG. 6).

Disposed under the lower shaft bearing 20 is a mixing chamber 27 which is enclosed with an annular insulating body 28 which latter also surrounds the shaft collar 2 and the lower half of the bearing 20.

Disposed at the outside of the sealing housing 9 are cooling water channels or ducts 29. The guide of the cooling water supply and/or discharge lines 30 (shown in dash-dotted lines herein) takes place from above via the annular air space 10.

Figure 2:
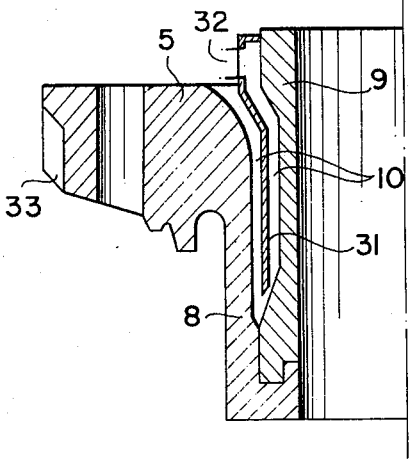
FIG. 2 is a longitudinal cross-sectional view through a pump cover with a screwed-in sealing housing and an air circulation collar.

The modified embodiment shown in FIG. 2 comprises — within the annular air space 10 between the pump cover 5 and the sealing housing 9 — an air circulation collar 31 which is connected on the upper side or part thereof to the sealing housing 9 in a tightly sealing manner and is open toward the bottom thereof. An air supply line 32 is disposed adjacent the upper area of the air circulation collar 31 and tangentially with respect thereto. Cast onto the outer jacket of the pump cover 5 are cooling ribs 33 which have the purpose of lowering the cover temperature.

Figure 3:
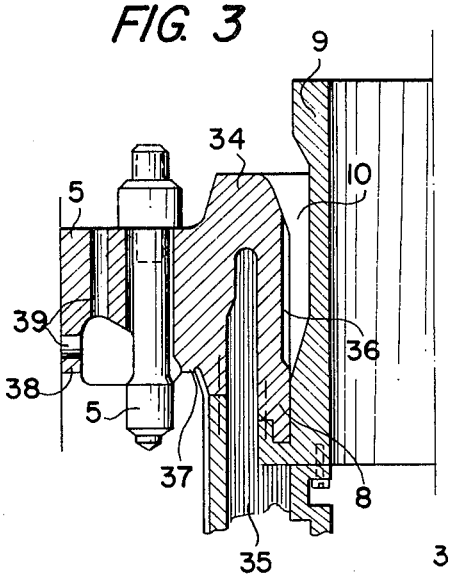
FIG. 3 is a longitudinal cross-sectional view through a pump cover being supported at the pump housing against an inner sealing surface and an outer supporting surface and whose bracket is connected with the upper cooler cover portion by means of a bead or reinforcement, with the sealing housing being inserted from below in the cover bracket.

The modified embodiment according to FIG. 3 shows a pump cover 5 whose projection 8 is connected with the upper cooler cover portion via a bead or reinforcement 34. The sealing housing 9 is inserted or slid from below into the cover projection 8 and screwed from below thereto.

The annular space which is positioned between the pump cover 5 and the cover projection 8 is filled with an insulation, for example the burled sheets 35. Disposed at the inner jacket or surface of the cover projection 8 are cooling ribs 36.

The cover is supported, in this particular construction, not only against the inner sealing surface 37, but also against the outer supporting surface 38 of the pump housing, and the cover screws 6 are in this case disposed as closely as possible to the sealing surface 37. For purposes of the better cooling of the cover, horizontal and vertical cooling bores 39 are provided therein.

This type of a cover and sealing housing construction is interesting particularly for short hot water pumps in which the sealing housing cannot be disposed as deeply within the pump housing.

Figure 5:
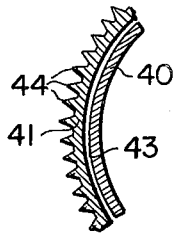
FIG. 5 is a local horizontal cross-sectional view through the internal cooler taken along line A-B of FIG 4.
Figure 4:
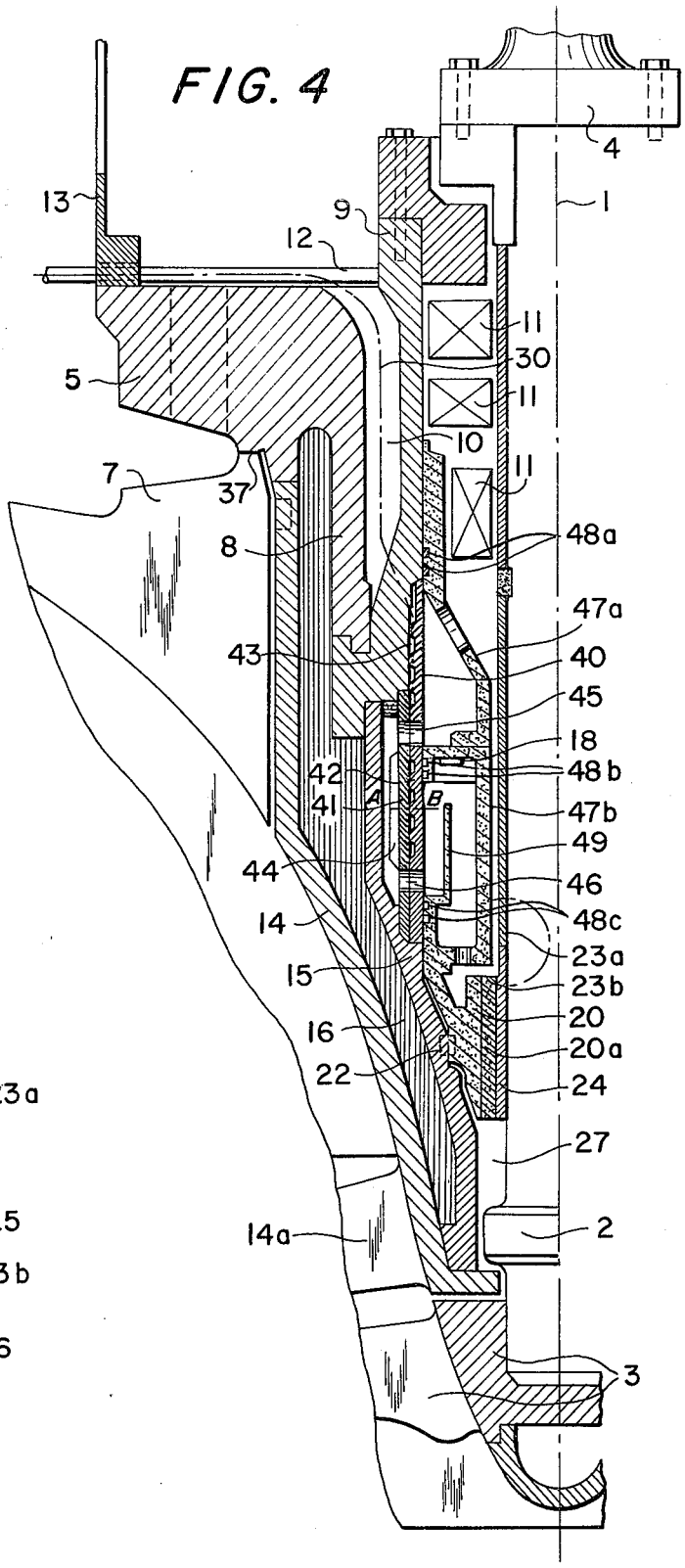
FIG. 4 is a longitudinal cross-sectional view of an upper pump portion of an axial pump with an internal cooler, wherein the inner supporting tube is screwed to the lowermost flange of the outer bearing or supporting tube.

In the construction and provision shown in FIG. 4, in which the reference numerals have the same meaning as those indicated in FIG. 1, the pump has an internal cooler with an annular cross-section. The internal cooler jacket or surface 40 and the outer cooler jacket or surface 41 are supported against each other by way of ribs 42. Present between the ribs 42 are the channels 43 through which flows the cooling water. The inner jacket or surface 41 and the outer jacket or surface 42 of the coolers are welded to the sealing housing 9. The guide (shown in dash-dotted lines) of the cooling water supply and discharge lines 30 takes place from above through the annular air space 10 between the sealing housing 9 and the pump cover 5 and, respectively. the cover projection 8. The lower end of the cooler is axially guided within the inner supporting or bracing tube 15 and radially held. The outer jacket or surface 42 of the cooler has cooling ribs 44 at the outside thereof (FIG. 5).

Disposed within the cooler in two normal axial planes are the radial bores 45 and 46, and it is through these bores that the lubricating water emerges or is discharged (for example, in case of blocking water failure, the hot water) from the inside of the cooler on the outside thereof, and then back again to the inside.

Provided within the cooler is the divided supporting tube 47*a*, 47*b*. The latter is so shaped that it forms via a part of the pump height and with the protective shaft sleeve 23*a*, 23*b* a long, narrow throttle gap. On the other hand, the supporting tube 47*a*, 47*b* touches with its three flanges the inner surface of the cooler and, respectively, of the sealing housing 9. Disposed at these contact or touching surfaces are the plastic sealing rings 48*a*, 48*b*, 48*c* of the supporting tube 47*a*, 47*b*. Disposed below the upper flange of the lower supporting tube portion 47*b* is an insulation 18 from burled sheeting.

Further provided within the lower supporting tube portion 47*b* is a guide cylinder 49 whose lower end is tightly connected with the lower flange of the aforementioned lower supporting tube portion 47*b*.

The lower shaft bearing 20, in this particular construction of provision, is equally attached below to the lower supporting tube portion 47*b*, but it is radially held within the inner supporting tube 15 by four wedges 22 which allow for an axial relative movement between the shaft bearing 20 and the inner supporting or bracing tube 15.

The protective shaft sleeve 23*a*, 23*b* is also divided into two parts, and the halves thereof are detachably connected with each other by means of the screws 25 and the nuts 26.

The bushing 24 on the shaft side at the lower end of the protective shaft sleeve 23*a*, 23*b* may be pulled out through the supporting tube 47*a*, 47*b*, since the outside diameter thereof is smaller than the inside diameter of the supporting or bracing tube.

The inner supporting or bracing tube 15 is so provided, in the pump shown in FIG. 4, that at its lower end it is rigidly screwed to the lower flange of the outer supporting or bracing tube 14, whereas it is radially held and axially movably guided with the upper end thereof within the sealing housing 9. As a result thereof, a relative movement between these two parts is possible, which arises due to the different expansions as a consequence of varying heating.

By virtue of this construction of the inner supporting or bracing tube 15, only a single, large, cohesive, annular space 16 exists in the pump which is filled with burled sheets or a similar insulating material. This annular space has no heat bridges. The lower shaft bearing 20 thus remains considerably cooler than it would be if it were radially supported against the outer supporting or bracing tube 14.

It will be obvious to those skilled in the art that many modifications may be made within the scope of the present invention without departing from the spirit thereof, and the invention includes all such modifications.

What is claimed is:

1. In a hot water pump having a cooled sealing housing in a pump cover in the upper pump portion, the improvement which comprises means mounting the sealing housing in a recess of the pump cover in a manner such that an annular air space is present between the outer surface of said sealing housing and the inner surface of the recess of the pump cover, said air space being in communication with the exterior space surrounding the pump.

2. A pump according to claim 1 in which the pump cover has a downwardly-extending projection thereon.

3. A pump according to claim 2 in which the projection is connected with an upper, cooler cover portion by means of a reinforcing means.

4. A pump according to claim 2 including an annular space between the pump cover and the cover projection filled with an insulating material.

5. A pump according to claim 2 including cooling ribs on the inner surface of the cover projection.

6. A pump according to claim 2 including means connecting the lower end of the sealing housing with the lower end of the cover projection.

7. A pump according to claim 6, in which the means connecting the sealing housing with the cover projection is a tongue and groove joint.

8. A pump according to claim 2, in which the outside diameter of an upper flange of the sealing housing is smaller, while the outside diameter of a lower flange of the sealing housing is greater than the inside diameter of the cover projection, whereby the sealing housing is adapted to be inserted from below into the cover projection.

9. A pump according to claim 1, including means supporting the pump cover at the pump housing against an inner sealing surface and against an outer supporting surface.

10. A pump according to claim 9, including cover screws mounted as closely as possible to said inner sealing surface.

11. A pump according to claim 1, including cooling bores within the pump cover,

12. A pump according to claim 1, including cooling ribs at the outer jacket surface of the pump cover.

13. A pump according to claim 1, including cooling water channels mounted at the outer surface of the sealing housing.

14. A pump according to claim 13, including cooling water supply and discharge lines to the cooling water channels of the sealing housing extending through the annular air space.

15. A pump according to claim 1, including an air circulation collar mounted around the sealing housing.

16. A pump according to claim 15, in which the air circulation collar is tightly connected at the upper end thereof with the sealing housing.

17. A pump according to claim 15, in which the air circulation collar is open at the lower end thereof.

18. A pump according to claim 15, including an air supply line terminating tangentially at the air circulation collar.

19. A pump collar to claim 1, including high-pressure pipe lines extending toward and from the sealing housing, as well as cooling water lines installed below an engine mounting for the pump.

20. A pump according to claim 1, including a closed cold water storage space below the sealing housing adapted to be removed through the sealing housing, and having an annular cross-section and an outside diameter smaller than the inside diameter of the sealing housing.

21. A pump according to claim 20, in which the cold water storage space is subdivided into two portions detachably connected with each other.

22. A pump according to claim 20, including an insulation disposed at the upper end of the cold water storage space.

23. A pump according to claim 20, in which the inside diameter of the inner jacket of the cold water storage space is so dimensioned over more than one fourth of the height thereof that a throttle gap of 1 to 2 millimeters radial extension is produced with respect to an adjacent protective shaft sleeve.

24. A pump according to claim 20, including at least one storage chamber disposed at the lower end of the inner jacket of the cold water storage space.

25. A pump according to claim 1, including an internal cooler disposed below the sealing housing with an annular cross-section.

26. A pump according to claim 25, in which the internal cooler is rigidly connected with the lower portion of the sealing housing.

27. A pump according to claim 25, in which the lower end of the internal cooler is radially held and axially guided within an inner supporting or bracing tube.

28. A pump according to claim 25, including rib portions supporting the inner jacket and the outer jacket of the internal cooler against each other.

29. A pump according to claim 25, including cooling ribs disposed at the outer surface of the internal cooler.

30. A pump according to claim 25, including radial bores in the internal cooler for the passage of lubricating water and hot water.

31. A pump according to claim 1, including a supporting tube below the sealing housing whose outside diameter is smaller than the inside diameter of the sealing housing, whereby it is adapted to be pulled out from the latter.

32. A pump according to claim 31, in which the supporting tube is subdivided and the parts thereof are detachably connected with each other.

33. A pump according to claim 32, including an insulation disposed at the upper end of the supporting tube lower portion.

34. A pump according to claim 31, in which the inside diameter of the supporting tube is so dimensioned over more than one fourth of the height thereof that a throttle gap of 1 to 2 millimeters radial extension is produced with respect to an adjacent protective shaft sleeve.

35. A pump according to claim 31, including a guiding cylinder disposed within the lower portion of the supporting tube, the lower edge of said cylinder being tightly connected with the lower flange of the supporting tube.

36. A pump according to claim 31, in which a central flange of the supporting tube rests sealingly against the inside surface of an internal cooler between upper and lower passage bores thereof.

37. A pump according to claim 1, including an outer supporting tube secured to the pump cover which, in the upper part with the outside diameter thereof, conforms to the inside diameter of the pump housing up to the smallest possible radial play.

38. A pump according to claim 2, including an inner supporting tube secured to one of the sealing housing or the cover projection and axially guided and radially held in an outer supporting tube.

39. A pump according to claim 38, in which the inner supporting tube is connected at the lower end thereof with the lowest flange of the outer supporting tube.

40. A pump according to claim 38, in which burled sheet is wound directly upon the inner supporting tube.

41. A pump according to claim 38, in which an annular space between the outer supporting tube and the inner supporting tube is filled with an insulation.

* * * * *